US009488402B2

(12) United States Patent
Almubarak

(10) Patent No.: US 9,488,402 B2
(45) Date of Patent: Nov. 8, 2016

(54) METHOD AND DEVICE FOR INSTANT ICE USAGE

(71) Applicant: Imtenan Ibrahim Almubarak, Chicago, IL (US)

(72) Inventor: Imtenan Ibrahim Almubarak, Chicago, IL (US)

( * ) Notice: Subject to any disclaimer, the term of this patent is extended or adjusted under 35 U.S.C. 154(b) by 418 days.

(21) Appl. No.: 14/134,702

(22) Filed: Dec. 19, 2013

(65) Prior Publication Data

US 2015/0176881 A1 Jun. 25, 2015

(51) Int. Cl.
*F25C 1/00* (2006.01)
*F25D 5/02* (2006.01)

(52) U.S. Cl.
CPC ..... *F25D 5/02* (2013.01)

(58) Field of Classification Search
CPC ..... F25C 1/00; F25C 1/02; F25C 1/10; F25D 5/02; F25D 5/00; B65D 81/32; B65D 81/3211; B65D 81/3266; B65D 81/18; C09K 5/18
See application file for complete search history.

(56) References Cited

U.S. PATENT DOCUMENTS 3,744,625 A * 7/1973 Chin ..... B65D 81/3266 206/219
4,462,224 A * 7/1984 Dunshee ..... A61F 7/106 206/219
4,979,370 A * 12/1990 Hotaling ..... F25C 1/243 62/307
2006/0016209 A1 1/2006 Cole et al.
2009/0293536 A1* 12/2009 Leske ..... F25C 5/00 62/530
2012/0192584 A1 8/2012 Fiaschi

FOREIGN PATENT DOCUMENTS

WO WO 01/14806 A1 3/2001
WO WO 02/100740 A1 12/2002

OTHER PUBLICATIONS

Ebay, "Tulz Icicle 13 Tear Drops Ice Cube Mold Silcone Molding Chocolate Oven Safe", http://www.ebay.com/itm/Tulz-Icicle-13-Tear-Drops-Ice-Cube-Mold-Silcone-Molding-Chocolate-Oven-Safe-/251120453353.

* cited by examiner

*Primary Examiner* — Elizabeth Martin
(74) *Attorney, Agent, or Firm* — Oblon, McClelland, Maier & Neustadt, L.L.P.

(57) ABSTRACT

A system and a method to produce instance ice provide instant ice usage anywhere and anyplace without a refrigerator, electricity or any other ice maker. A portable instant ice piece producing system includes an instant ice piece device being a sealed package holding a coolant proof package filled in a plurality of sealed pocket filled with water fluid, a coolant particle, a water bag filled with water, and a processing circuitry configured to press or knead the instant ice bag and break the water bag such that the coolant particle is mixed with the water released from the water bag and the plurality of sealed water fluids is frozen to a plurality of sealed ice pieces and cut the instant ice piece device to provide the plurality of sealed ice pieces.

9 Claims, 8 Drawing Sheets

METHOD AND DEVICE FOR INSTANT ICE USAGE

FIELD OF THE DISCLOSURE

The present disclosure relates to a method and a product for ice usage, with the aim of providing ice usage instantly anywhere and anyplace without a refrigerator, electricity or any other ice maker.

BACKGROUND

Most ice cooling products in market are ice cubes. The ice cubes are in plastic bags of various sizes, and contain a certain number, usually a large number, of cubes. Bagged ice may be found in most grocery stores, convenience stores, gas stations and/or superstores. These ice bags are typically stored in freezers of such locations. Usually, the ice bags provided by the store require some form of delivery, usually by truck, to the store. Due to unforeseen traffic and delivery equipment failures, ice is very expensive and is severely taxed during hot summer months especially during long holiday weekends and again the issue is raised as to under what conditions the ice was manufactured, transported and stored.

Often, pre-bagged ice bags, whether made offsite and shipped to a retail site or bagged onsite and stored in bagged form, are frozen hard and are days and weeks old before a consumer can obtain them. Such pre-bagged hard ice is stale and can undesirably take on odors during storage or transport. Also, pre-bagged ice often agglomerates into chunks of ice that are too large for consumers to readily use. For example, they will no longer fit into a cup or a can, which forces the consumer to take additional efforts to reduce the ice agglomerate size before use.

There are also situations where one or more persons may desire to distribute a small number of liquid drinks to a specific group where only a small quantity of ice is needed. For example, at a small party, a cooler is usually present filled with ice cubes and a variety of liquid drinks, such as bottled water, soft drinks, beer, wine, wine coolers, etc. If a guest wishes to add ice to his or her glass or cup prior to adding a beverage, then a separate container or bag of ice is needed since the ice cubes stored in the cooler cannot be used for this purpose. Typically, the ice cubes stored in the cooler have become contaminated by the beverage containers placed in it as well as by other people reaching their hands into the cooler to retrieve a beverage.

Furthermore, there are various situations where ice is served to a multitude of individuals in public. The primary commercial venue focuses on situations where a vendor hand-delivers a disposable paper or plastic glass or cup with ice to a customer. The vendor then distributes or sells a liquid or fluid, such as a bottle of water, a container or can of a beverage. The most time-consuming part of this entire process is getting the ice out of a relatively large plastic bag, usually a ten pound bag of ice, and depositing several ice cubes into each cup. Furthermore, the large plastic bag of ice is usually torn open and does not include a re-sealable feature. Therefore, there is no easy way to reseal the partially used bag of ice. In addition, the ice in the large open bag can become contaminated before, during or after transfer of some of the ice cubes to individual cups. This presents a significant health risk to the remaining other customers who may receive ice from the large contaminated bag of ice.

An ice cube mold filled with water may be put in the refrigerator to generate ice cube for cooling the beverage. However, the water used to make ice cube may not be hygiene.

A typical example is the tourist who, by not being immunized against local microorganisms, cannot consume safely the water of the water system even if he or she wants to.

This problem actually exists in most countries, since only a few countries have hygienically safe water available. In practice, albeit to a lesser extent, the need to make hygienically safe ice available exists also in countries where the water of the water system would actually be potable but where, due to cultural reasons and to actual immune deficits, a number of people prefer not to consume water from the water system.

It is known in fact that in many countries the water system does not supply potable water or supplies water that does not have sufficient assurances of hygiene, and for this reason the use of this water to produce ice for human consumption is not advisable. Accordingly, especially in countries with a hot climate, where the need to use ice, for example in beverages, is felt more strongly, it is impossible or at least risky to use ice safely.

Furthermore, ice cubes is typically stored in a freezer at grocery stores, convenience stores, gas stations and/or superstores. When a traveler in the field where there are no stores, no freezer and electricity, he/she may not be able to cool the beverage.

Thus, as recognized by the present inventor, it is desired to provide an apparatus and method whereby that a consumer can receive fresh-made pre-sealed hygiene and flavored ice piece fit with a small opening of a standard can or bottle conveniently, at any time of the day or night, at anywhere around the world. It is also desired that the ice pieces is made onsite to avoid the cost, expense, and time-lag of transporting pre-bagged ice to a retail site where consumers may purchase. It is further desired that the ice pieces can be generated without electricity, refrigerator or other ice maker.

SUMMARY

A portable instant ice piece producing system, includes: an instant ice piece device including within a sealed package, a coolant proof package having a plurality of sealed pockets filled with water-based fluid, a coolant pocket that holds a coolant therein, a water bag filled with another water-based fluid, and a processing circuitry configured to control a kneading mechanism that kneads the instant ice piece device so as to break the water bag so that the coolant is mixed with the water-based fluid released from the water bag to freeze at least one of sealed pockets filled with water-based fluid to provide at least one sealed ice piece within at least one of sealed pockets filled with water-based fluid and a cutting mechanism that cuts the instant ice piece device so as to take off the sealed pockets filled with at least one of the ice pieces.

In the first feature, the single pocket of the plurality of sealed pockets filled with water-based fluid one of sealed water fluid is shaped to fit a neck of a standard bottle or a cap of a standard can.

In the first feature, the shape is a tear drop shape.

In the first feature, the water-based fluid in the at least one pocket includes a flavoring.

In the first feature, the water-based fluid in the at least one pocket includes a colorant.

A method for providing instant ice, includes: receiving with a processing circuitry a request for instant cooling; providing with a processing circuitry an instant ice piece device including within a sealed package, a coolant proof package having a plurality of sealed pockets filled with water-based fluid, a coolant pocket that holds a coolant therein, and a water bag filled with another water-based fluid; pressing or kneading with a processing circuitry configured to control a kneading mechanism the instant ice device so as to break the water bag so that the coolant is mixed with the water-based fluid released from the water bag to freeze at least one of sealed pockets filled with water-based fluid to provide at least one sealed ice piece within at least one of sealed pockets filled with water-based fluid; taking out with a processing circuitry configure to control a cutting mechanism the plurality of sealed pockets filled with ice pieces from the instant ice piece device; separating off a single one of the sealed ice piece; breaking a seal on the single sealed unit to release a single ice piece; cooling the objects with the ice piece; and adding more ice pieces if needed.

In the second feature, the single pocket of the plurality of sealed pockets filled with water-based fluid one of sealed water fluid is shaped to fit a neck of a standard bottle or a cap of a standard can.

In the second feature, the shape is a tear drop shape.

In the second feature, the water-based fluid in the at least one pocket includes a flavoring.

In the second feature, the water-based fluid in the at least one pocket includes a colorant.

BRIEF DESCRIPTION OF THE DRAWINGS

FIG. 3(*b*) is a perspective view of the instant ice device of FIG. 1 after the coolant activation.

FIG. 4 (*b*) is a schematic view of a teardrop shaped ice piece.

FIG. 4 (*c*) is a schematic view of a plurality of water containers coupled together.

FIG. 5(*b*) is a side view of the kneading device with the instant ice device to be pressed in a full open position.

FIG. 5(*c*) is a side view of the kneading device with the instant ice device to be pressed in a partially closed position.

FIG. 6(*b*) is a side view of the kneading device with the instant ice device to be cut.

FIG. 7(*b*) is a perspective view of the ice piece that fits into a neck of a standard drinking bottle.

DETAILED DESCRIPTION OF THE EMBODIMENTS

An exemplary portable instant ice piece producing system will be described with respect to FIGS. 1-8.

Figure 1:
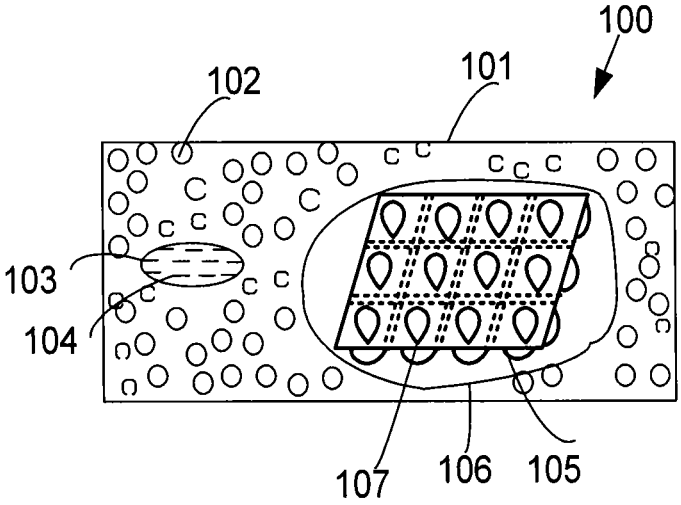
FIG. 1 is a perspective view of an instant ice device according to the invention.

FIG. 1 shows an instant ice piece device 100 implemented in accordance with the present disclosure as a sealed package 101, comprising coolant 102, a small water bag 103 filled with water (H2O) 103, a water container sheet 105 with a plurality of aluminum foil sealed pockets filled with water fluid 107 and a coolant proof package 106. The sealed package 101 may be a plastic bag. An example coolant 102 may include in a mixture of 98% ammonium, nitrate 1% sodium carboxyl methyl cellulose, and 1% sodium chloride. Such a chemical reaction is capable of cooling an object at about 26° C. These constituents are pre-mixed to form a particle like material.

Figure 2:
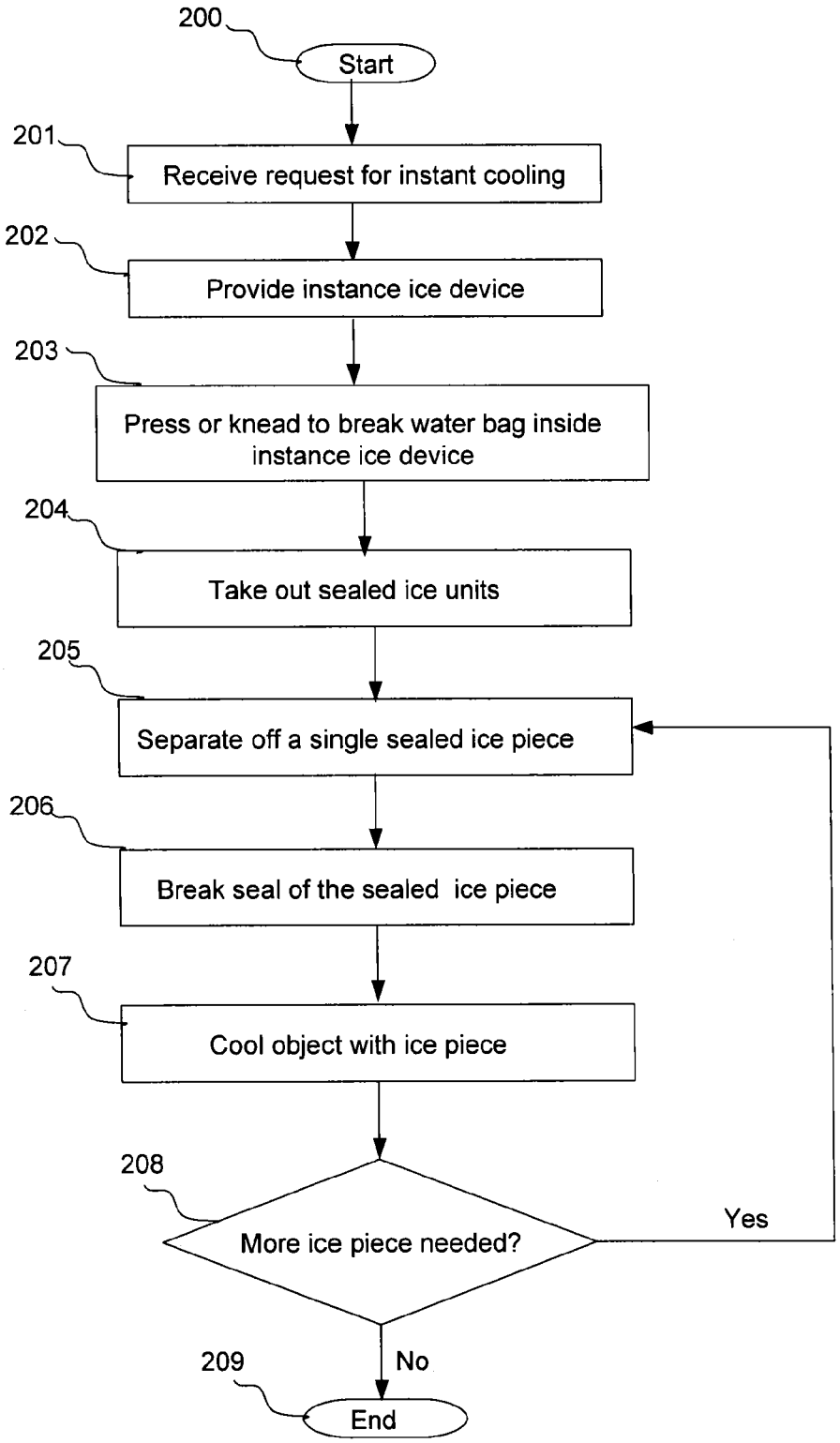
FIG. 2 is a flowchart of a method of producing a pre-packaged of instant ice product.

As FIG. 2 shows, a processing circuitry receives a request for instant cooling a drink at step 201. At step 202, the processing circuitry provides the instant ice piece device 100. During step 203, the processing circuitry triggers a control of a pressing or kneading of the water bag 103 inside the portable instant ice piece device 100 with a mechanical kneading service. A manually pressing or kneading operation may also be used. Instantly, a chemical reaction occurs as the coolant 102 inside the instant ice device mixes with water 104 released from the water bag 103. The chemical reaction freezes the drinking water fluids 107 sealed in the water container sheet 105 to ice. From step 204 to 205, the water container sheet 105 is taken out from the instant ice device 100 through a mechanical cutting service and the single one of aluminum foil sealed ice pieces is separated off from the water container sheet 105. A manually cutting operation may also be used. From step 206 to step 207, a seal of the single one of ice pieces is broken and is used to cool the drink. If more ice pieces needed, repeat the step 205 to 207 until no more ice pieces are needed.

Figure 3A:
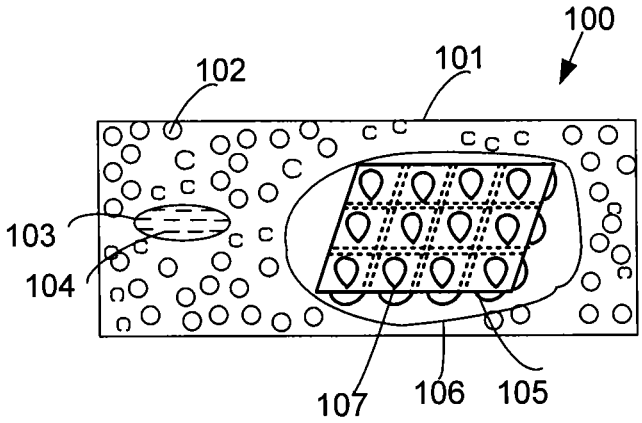
FIG. 3(*a*) is a perspective view of an instant ice device of FIG. 1 before coolant activation.
Figure 3B:
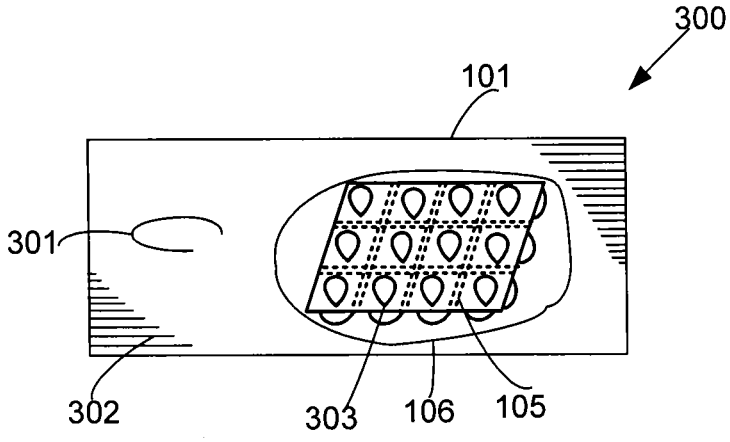

FIG. 3(*a*) is a perspective view of the instant ice piece device of FIG. 1 before coolant activation. It shows the instant ice device 100 implemented as the sealed package 101 comprising the coolant 102, the water bag 103 filled with water fluid 104, the water container sheet 105 with the plurality of aluminum foil sealed pocket filled with the water fluid 107 and the coolant proof package 106. The sealed package 101 may be a plastic bag. An example coolant 102 may include in a mixture of 98% ammonium, nitrate 1% sodium carboxyl methyl cellulose, and 1% sodium chloride. Such a chemical reaction is capable of cooling a object at about 26° C. These constituents are pre-mixed to form a particle like material.

FIG. 3(*b*) is a perspective view of the instant ice device of FIG. 1 after the coolant activation 300. The chemical reaction occurs instantly when the water 103 (FIG. 3(*a*)) is released from a broken water bag 301 mixed with the coolant 102. This chemical reaction freezes the water fluid 107 (FIG. 3(*a*)) sealed in the water container 105 to the ice pieces 303.

Figure 4A:
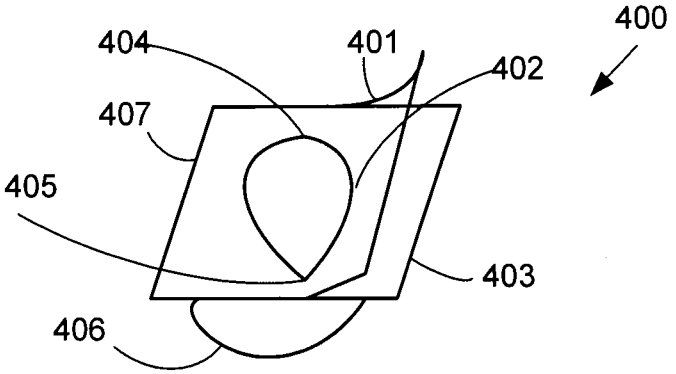
FIG. 4(*a*) is a perspective view of an individually packed ice piece container.
Figure 4B:
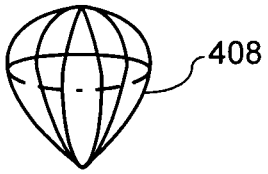
Figure 4C:
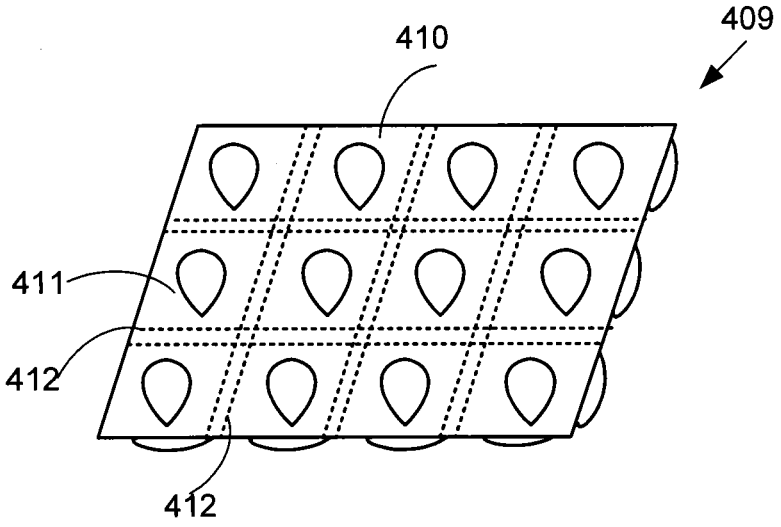

In FIG. 4(*a*), a water container sealed in the aluminum foil 400 includes a case 403, a water fluid 402 and a peel back top 401.

The case 403 is made from a thin plastic that is suitable for repeated freezing and thawing. Many suitable plastics are known, including high and low density polyethylene, and polystyrene. Other materials are, however, also considered, including paper and metal containing materials. The common "creamer" containers that typically contain cream and milk, are not designed for repeated freezing and thawing, and tend to leak after only 1 or 2 freezing cycles. In this embodiment, the container may withstand from 1 to infinity freezing and thawing cycles without noticeable leaking based on different applications. The case 403 is configured to form teardrop-shaped water fluid 402. The teardrop-shaped water fluid 402 has a narrow end 405 and a wide end 404. The case 403 is formed so that a narrow or downstream end 405 of the water fluid 402 is on a bottom side 406 of the case 403 and a wide end 404 is on a top side 407 of the case 403.

The water fluid 402 is to be interpreted as a water-based fluid with other substance included as per the different applications in which if it is used. The water fluid 402 may be water alone, or water with flavors, colors, and other non-water ingredients which are intended for human consumption. In an example embodiment, the other substance is medication, perhaps with a bitter taste, which is more palatable when ingested in cold. The water fluid may also include one or more of a flavoring ingredient and a coloring ingredient, such as apple, orange, or other flavored water fluids, non-natural flavors such as COCA-COLA™ or other soft drinks. The frozen water fluid may contain the coloring ingredient and serve as a decoration to a drink.

The peel back top 401 may be used to seal a cover the container 400. The peel back top 401 of the case 120 is weak enough to allow the ice piece to be punctured through the surface when sufficient pressure is applied to the bottom of the case. Or the peel back top 401 may be ripped apart from the container 400. Regardless of the method used to open the container 400, the container 100 may be either non re-sealable or re-sealable based on the different applications.

FIG. 4(*b*) is an ice piece in the shape of a teardrop 408. In this embodiment, the ice piece fits a neck of a standard bottle and a cap of a standard can, so that other containers may be saved. The length of the ice pieces may be between 1.5 cm and 2.3 cm, the maximum width of the ice pieces may be between 1 cm and 1.9 cm, (as the neck size of the standard bottle is 2.54 cm*2.54 cm and the cap size of the standard can is 2.4 cm*2 cm). The tear drop shape of ice piece allows ice pieces to enter the drink bottles with less resistance and avoids melting of the ice. The tear drop shape also allows for deeper penetration into the beverage, thus providing more uniform cooling through the beverage. Other shapes may also be used as long as they can fit the neck of the standard bottle and the cap of the standard can.

In FIG. 4(*c*), a plurality of coupled water containers 409 are depicted. Each container 410 is coupled to another container by a peel back top 411 that has perforations 412 which make it easy to separate coupled containers. A plurality of sealed ice pieces can be extracted individually-which is hygiene and give a user more control on how much ice they want to use for the beverage and avoid the waste of ice.

In this embodiment, in anyplace and anywhere, the instant ice device 100 is provided to supply the ice pieces 408 without the use of refrigerator, electricity, or any other ice maker. The water bag 103 is pressed or kneaded the water bag through the kneading mechanism and instantly, the chemical reaction occurs as the coolant 102 inside the instant ice device mixes with water 104 released from the water bag 103. Such a chemical reaction freezes the water fluid 107 sealed in the water container sheet 105 to form ice pieces. A plurality of coupled water containers 409 is taken out from the instant ice device 100 through the cutting mechanism. The user can decide to use an appropriate number of ice pieces based on different conditions. If the weather is hot, the user may decide to use most of the ice pieces available. If the weather is cold, the user may decide to use only a portion of the ice pieces available. The remaining containers may then be provided for another user, or saved for later usage.

Figure 5A:
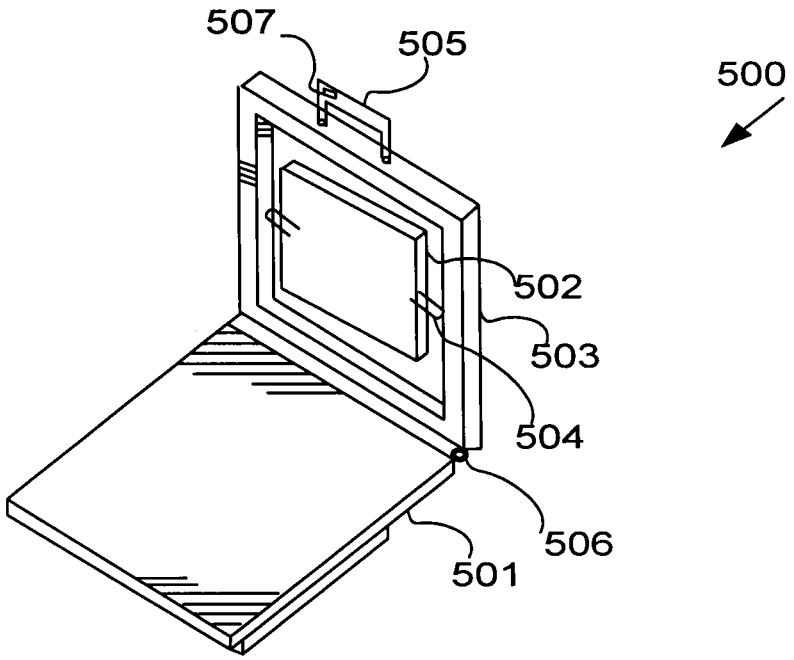
FIG. 5(*a*) is a front perspective view of a kneading device for the instant ice device.

FIG. 5(*a*) shows an embodiment of a kneading device 500. The kneading device 500 includes a bottom flat press plate 501, a upper flat press plate 502, a supporting frame 503, a pin 504, a handle 505, a coil spring 506 and a processing circuitry 507. The bottom flat press plate 501 is hinged to the support frame 503 through the coil spring 506. The handle 505 is bolted to the top of support frame 503. This handle is configured through the processing circuitry 507 to pull downward to knead and press the instant ice device to break the water bag inside the instant ice piece device so that the coolant is mixed with the water fluid released from the water bag to freeze water fluid at the sealed pockets to provide sealed ice pieces. A top press plate 504 may be shaped in the form of a flat quadrilateral, a flat circular or a flat octagon.

Figure 5B:
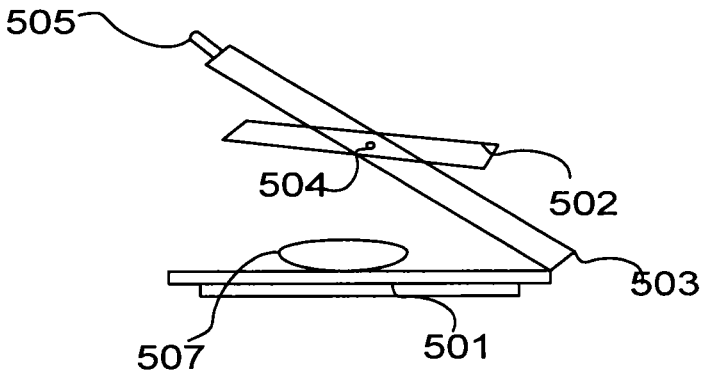
Figure 5C:
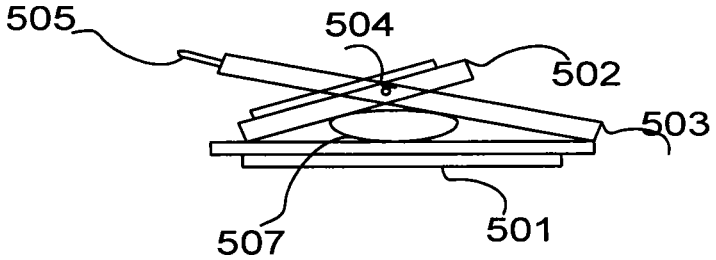

FIG. 5(*b*) to FIG. 5(*c*) shows the operation of the kneading. FIG. 5*b* shows the kneading device 500 open and the position of the upper flat press plate 502 and the supporting frame 503. The supporting frame 503 is held open by the coil spring 506. The upper flat press plate 502 is held at an angle by the support frame 503 and the pin 504. As seen in FIG. 5*c*, as the kneading device is closed, the top of the upper flat press plate 502 contacts the bottom flat press plate 501 first. As the kneading device is further closed, the upper flat press plate 504 rotates downward toward the bottom flat press plate 501 pivoting and sliding at its front corner down toward the instant ice device 507. The advantage of the pivotal connection of the upper flat press plate 502 to the support frame 503 is that as the kneading device is being closed, the instant ice piece device 507 is pressed evenly from front to back to break the water bag. When pressure is released from the handle 505, the coil spring 504 returns the supporting frame 503 to its open position.

Figure 6A:
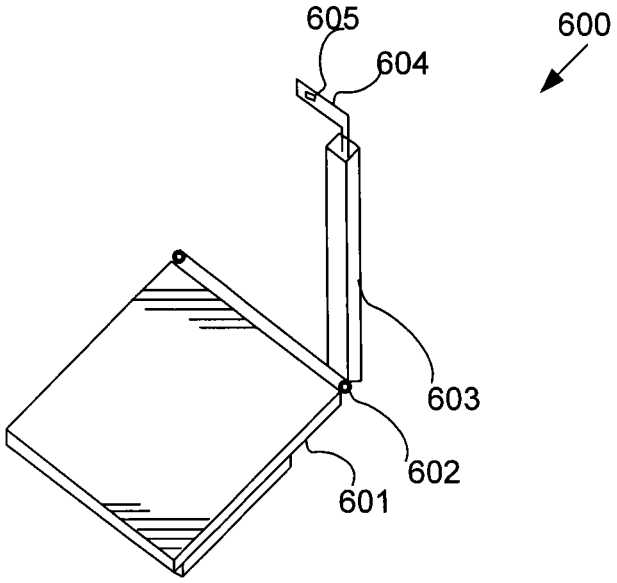
FIG. 6(*a*) is a front perspective view of a cutting device for the instant ice device.
Figure 6B:
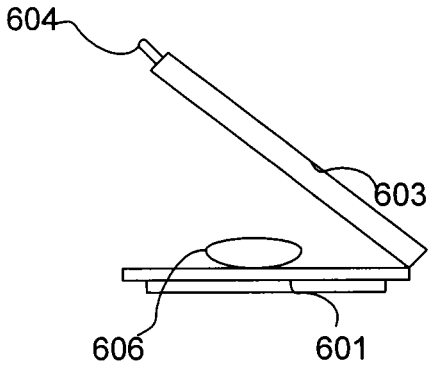

FIG. 6(*a*) shows an embodiment of a cutting device 600. The cutting device 600 includes a bottom flat plate 601, a coil spring 602, a cutter 603, a handle 604 and a processing circuitry 605. The bottom flat press plate 601 is hinged to the cutter 603 through the coil spring 602. The handle 604 is bolted to the top of cutter 603. FIG. 6(*b*) shows the operation of the cutting device. This handle 604 is configured through the processing circuitry 605 to pull downward to cut the instant ice piece device 606 to take out the plurality of aluminum foil sealed pockets filled with the frozen ice pieces from the instant ice piece device.

Figure 7A:
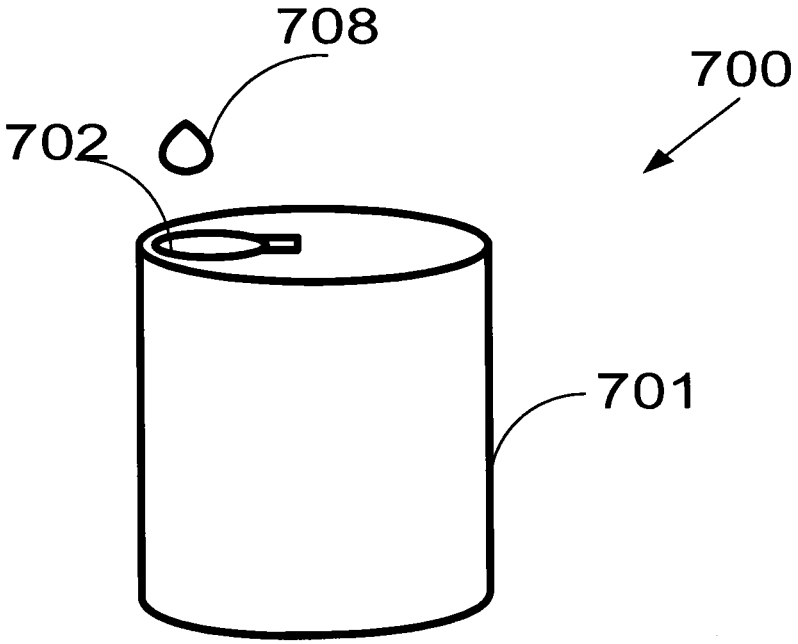
FIG. 7(*a*) is a perspective view of the ice piece that fits into cap of a standard drinking can.
Figure 7B:
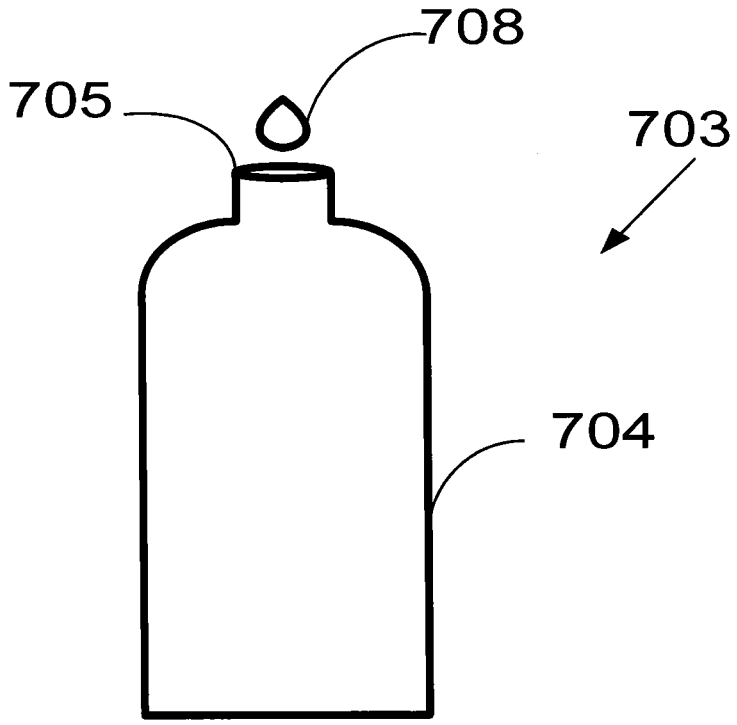

FIG. 7(*a*) 700 is a perspective view of the ice piece that fits into a cap 702 in a standard drinking can 701. FIG. 5(*a*) shows a standard drink can 701 and a packet of substantially frozen ice piece 708. The teardrop shape of the frozen ice piece 708 makes it easy to insert into the drink can 701. In the embodiment depicted by FIG. 5(*a*), a drink may be cooled, or flavored or colored by the frozen ice pieces 708. The case for the frozen ice piece 708 would likely have substantially the same overall size and shape as the frozen ice piece 708.

FIG. 7(*b*) 703 is a perspective view of the ice piece that fits into the neck 705 of the standard bottle 704. The teardrop shape of the frozen ice pieces 708 make it easy to insert into the standard bottle 704. In the embodiment depicted by FIG. 5(*b*), a drink may be cooled, or flavored or colored by the frozen ice piece 708.

Figure 8:
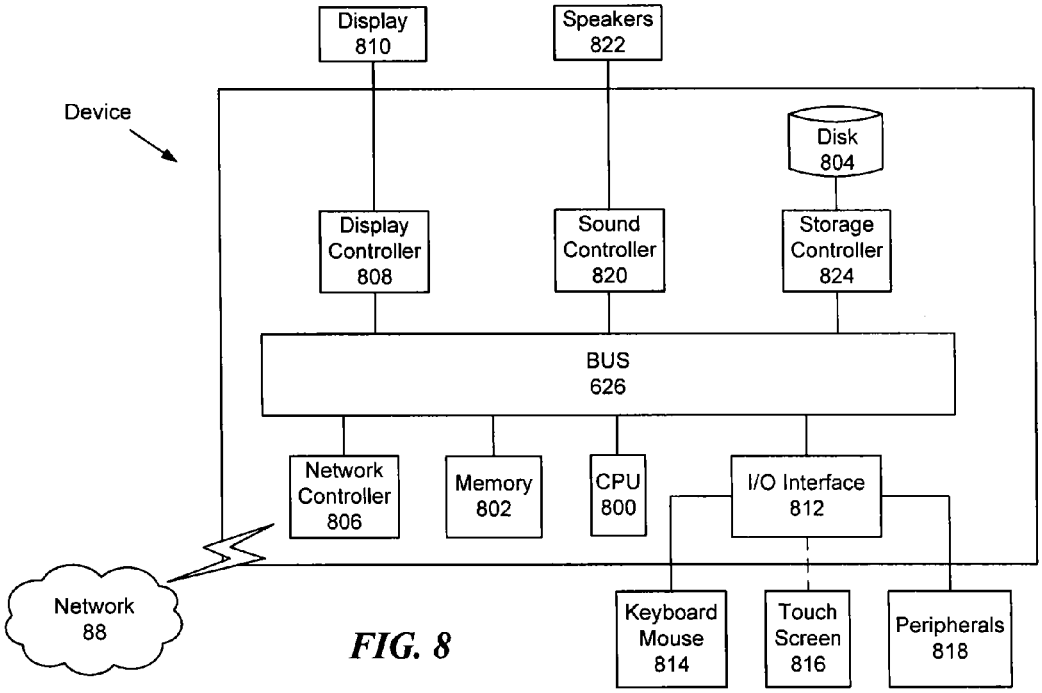
FIG. 8 is a diagrammatic overview of a system for implementing the method of producing a instant ice piece product according to the present disclosure.

Next, a hardware description of the device according to exemplary embodiments is described with reference to FIG. 8. In FIG. 8, the device includes a CPU 800 which performs the processes described above. The process data and instructions may be stored in memory 802. These processes and instructions may also be stored on a storage medium disk 804 such as a hard drive (HDD) or portable storage medium or may be stored remotely. Further, the claimed advancements are not limited by the form of the computer-readable media on which the instructions of the inventive process are stored. For example, the instructions may be stored on CDs, DVDs, in FLASH memory, RAM, ROM, PROM, EPROM, EEPROM, hard disk or any other information processing device with which the device communicates, such as a server or computer.

Further, the claimed advancements may be provided as a utility application, background daemon, or component of an operating system, or combination thereof, executing in conjunction with CPU 800 and an operating system such as Microsoft Windows 7, UNIX, Solaris, LINUX, Apple MAC-OS and other systems known to those skilled in the art.

CPU 800 may be a Xenon or Core processor from Intel of America or an Opteron processor from AMD of America, or may be other processor types that would be recognized by one of ordinary skill in the art. Alternatively, the CPU 800 may be implemented on an FPGA, ASIC, PLD or using discrete logic circuits, as one of ordinary skill in the art would recognize. Further, CPU 800 may be implemented as multiple processors cooperatively working in parallel to perform the instructions of the inventive processes described above.

The device in FIG. 8 also includes a network controller 806, such as an Intel Ethernet PRO network interface card from Intel Corporation of America, for interfacing with network 88. As can be appreciated, the network 88 can be a public network, such as the Internet, or a private network such as an LAN or WAN network, or any combination thereof and can also include PSTN or ISDN sub-networks. The network 88 can also be wired, such as an Ethernet network, or can be wireless such as a cellular network including EDGE, 3G and 4G wireless cellular systems. The wireless network can also be WiFi, Bluetooth, or any other wireless form of communication that is known.

The device further includes a display controller 808, such as a NVIDIA GeForce GTX or Quadro graphics adaptor from NVIDIA Corporation of America for interfacing with display 810, such as a Hewlett Packard HPL2445w LCD monitor. A general purpose I/O interface 812 interfaces with a keyboard and/or mouse 814 as well as a touch screen panel 816 on or separate from display 810. General purpose I/O interface also connects to a variety of peripherals 818 including printers and scanners, such as an OfficeJet or DeskJet from Hewlett Packard. In this embodiment, the peripherals 818 include the kneading device and the cutting device. Another peripherals 818 is a temperature sensor that measure a temperature of liquid and provides a readout and a warning message to display 810 which may be a smart watch with a Bluetooth connection to the device of FIG. 8.

A sound controller 820 is also provided in the device, such as Sound Blaster X-Fi Titanium from Creative, to interface with speakers/microphone 822 hereby providing sounds and/or music.

The general purpose storage controller 824 connects the storage medium disk 904 with communication bus 826, which may be an ISA, EISA, VESA, PCI, or similar, for interconnecting all of the components of the device. A description of the general features and functionality of the display 810, keyboard and/or mouse 814, as well as the display controller 808, storage controller 824, network controller 806, sound controller 820, and general purpose I/O interface 812 is omitted herein for brevity as these features are known.

It is to be understood that the present invention is not limited to the embodiments described above, but encompasses any and all embodiments within the scope of the following claims.

The invention claimed is:

1. A portable instant ice piece producing system, comprising:

an instant ice piece device included within a sealed package;

a coolant proof package having a plurality of sealed pockets filled with water-based fluid;

a coolant pocket that holds a coolant therein;

a water bag filled with another water-based fluid;

a kneading mechanism including a bottom flat press plate and a upper flat press plate connected to a support frame with a handle, the kneading mechanism being configured to press the instant ice piece device between the bottom flat press plate and the upper flat press plate via movement of the handle to knead the instant ice piece device so as to simultaneously break the water bag and the coolant proof package so that the coolant is mixed with the water-based fluid released from the water bag to freeze at least one of sealed pockets filled with water- based fluid to provide at least one sealed ice piece within at least one of sealed pockets filled with water- based fluids; and a cutting mechanism that cuts the instant ice piece device so as to take off the sealed pockets filled with at least one of the ice pieces.

2. The system of claim 1, wherein the single pocket of the plurality of sealed pockets filled with water-based fluid one of sealed water fluid is shaped to fit a neck of a standard bottle or a cap of a standard can.

3. The system to produce the at least one ice piece of claim 2, wherein the shape is a tear drop shape.

4. The system of claim 3, wherein the water-based fluid in the at least one pocket includes a flavoring.

5. The system of claim 3, wherein the water-based fluid in the at least one pocket includes a colorant.

6. The system according to claim 1, wherein the bottom flat press plate is hinged to the support frame and the upper flat press plate is hingedly connected inside the support frame to provide a pivot for the upper flat press plate with respect to the support frame.

7. The system according to claim 6, wherein the upper flat press plate pivots to simultaneously compress, in a single press of the upper flat press plate, the instant ice piece device from the front to back to break the water bag and the coolant proof package to cause mixing of the water-based fluid and the coolant.

8. The system according to claim 6, further comprising:

a coil spring provided at the hinge between the support frame and the bottom flat press plate, wherein the coil spring is configured to maintain an open position between the support frame and the bottom flat press plate.

9. The system according to claim 1, wherein a first sealed pocket of the plurality of sealed pockets is coupled to a second sealed pocket of the plurality of sealed pockets with perforations therebetween to enable separation of the first sealed pocket and the second sealed pocket upon freezing of the at least one of sealed pockets.

* * * * *